US005955230A

United States Patent [19]

Kimura et al.

[11] Patent Number: 5,955,230

[45] Date of Patent: Sep. 21, 1999

[54] ELECTROPHOTOGRAPHIC PHOTORECEPTOR HAVING PROTECTIVE LAYER AND METHOD FOR FORMING IMAGES

[75] Inventors: Takaaki Kimura; Fumio Ojima; Kazuyuki Nakamura; Hirofumi Nakamura, all of Minami Ashigara, Japan

[73] Assignee: Fuji Xerox Co., Ltd., Tokyo, Japan

[21] Appl. No.: 08/851,316

[22] Filed: May 5, 1997

Related U.S. Application Data

[63] Continuation of application No. 08/538,584, Oct. 3, 1995, abandoned.

[30] Foreign Application Priority Data

Sep. 14, 1995 [JP] Japan ..... 7-236545
Oct. 4, 1997 [JP] Japan ..... 6-263267

[51] Int. Cl.[6] ..... G03G 5/147

[52] U.S. Cl. ..... 430/67; 430/66; 430/125

[58] Field of Search ..... 430/67, 96, 125, 430/132, 66

[56] References Cited

U.S. PATENT DOCUMENTS 4,423,131 12/1983 Limburg et al. ..... 430/67
4,426,435 1/1984 Oka ..... 430/132
4,716,091 12/1987 Yoshihara et al. ..... 430/96

FOREIGN PATENT DOCUMENTS

B-44-834 1/1944 Japan .
A-60-3638 1/1985 Japan .
A-61-189559 8/1986 Japan .
A-63-159865 7/1988 Japan .
63-316058 12/1988 Japan .
A-2-000078 1/1990 Japan .
A-3-280068 12/1991 Japan .
A-5-45920 2/1993 Japan .

*Primary Examiner*—Christopher D. Rodee
*Attorney, Agent, or Firm*—Oliff & Berridge, PLC

[57] ABSTRACT

An electrophotographic photoreceptor excellent in wear resistance and low in residual potential comprising a conductive support, and a photoconductive layer and a protective layer formed on the conductive support. The protective layer contains a finely divided metal oxide powder and a binder resin composed of a polymer containing an acrylate or a methacrylate having at least one silicon-containing functional group as a monomer component, the polymer being crosslinked with said silicon-containing functional group. Also disclosed is an image forming method using the electrophotographic photoreceptor.

14 Claims, 8 Drawing Sheets

ELECTROPHOTOGRAPHIC PHOTORECEPTOR HAVING PROTECTIVE LAYER AND METHOD FOR FORMING IMAGES

This is a Continuation of application Ser. No. 08/538,584 filed Oct. 3, 1995, now abandoned.

FIELD OF THE INVENTION

The present invention relates to an electrophotographic photoreceptor excellent in wear resistance and low in residual potential, and to a method for forming images using the same.

BACKGROUND OF THE INVENTION

Previously, various methods for improving print life of organic photoreceptors have been proposed. In particular, JP-A-60-3638 (the term "JP-A" as used herein means an "unexamined published Japanese patent application") discloses an electrophotographic photoreceptor in which a wear-resistant layer is formed on a photoconductive layer to give the function of the wear resistance to this layer, to thereby improve the print life by separating functions. This electrophotographic photoreceptor can be significantly improved in durability by providing a layer in which a finely divided conductive powder is dispersed in a binder resin, but include the following problem. Namely, although the finely divided conductive powder for adjusting a resistance is dispersed, electric charge is accumulated in the binder resin, resulting in the increased residual potential, particularly under the circumstances of low humidity. Furthermore, JP-A-5-45920 discloses an electrophotographic photoreceptor having a protective layer in which a finely divided powder of a fluororesin such as polytetrafluoroethylene is incorporated in an amount of up to about 7% by weight. However, this electrophotographic photoreceptor has the problem that an increase in residual potential is observed, though excellent in durability.

As a countermeasure to prevent an incase in residual potential, JP-B-44-834 (the term "JP-B" as used herein means an "examined Japanese patent publication") and JP-A-3-280068 disclose addition of specific chemical compounds. However, an essential improvement is not attained. Namely, the addition of the specific chemical compounds raises the problem of changes with time, and it is difficult to maintain stability over a long period of time.

Further, binder resins containing graft polymers having silicon atoms at their side chains are described in JP-A-61-189559, etc. In this case, silicon atom-containing branched chain moieties of these binder resins are intended to move to interfaces to give lubricity and mold releasing character, essential properties of silicone, to a surface layer. However, these binder resins does not exhibit good wear resistance.

SUMMARY OF THE INVENTION

An object of the present invention is to provide an electrophotographic photoreceptor having a protective layer not increased in residual potential and low in wearability.

Another object of the present invention is to provide an image forming method which can form an image excellent in image quality, using the above-described electrophotographic photoreceptor.

The above objects of the present invention is achieved by providing:

an electrophotographic photoreceptor comprising an electrically conductive support having thereon a photoconductive layer and a protective layer in this order, wherein said protective layer contains (a) a finely divided metal oxide powder and (b) a binder resin comprising a polymer containing, as a monomer component, an acrylate or a methacrylate having at least one silicon-containing functional group, and said polymer is crosslinked with said silicon-containing functional group; and an image forming method which comprises: forming an electrostatic latent image on an electrophotographic photoreceptor comprising an electrically conductive support having thereon a photoconductive layer and a protective layer in this order;

developing said latent images to form a toner image;

transferring said toner image; and cleaning the surface of said electrophotographic photoreceptor with a contact cleaning means to repeatedly form an image, wherein said protective layer of the electrophotographic photoreceptor contains (a) a finely divided metal oxide powder and (b) a binder resin comprising a polymer containing, as a monomer component, an acrylate or a methacrylate having at least one silicon-containing functional group, and said polymer is crosslinked with said silicon-containing functional group.

BRIEF DESCRIPTION OF THE DRAWINGS

In the accompanying drawings.

DETAILED DESCRIPTION OF THE INVENTION

Figure 1:
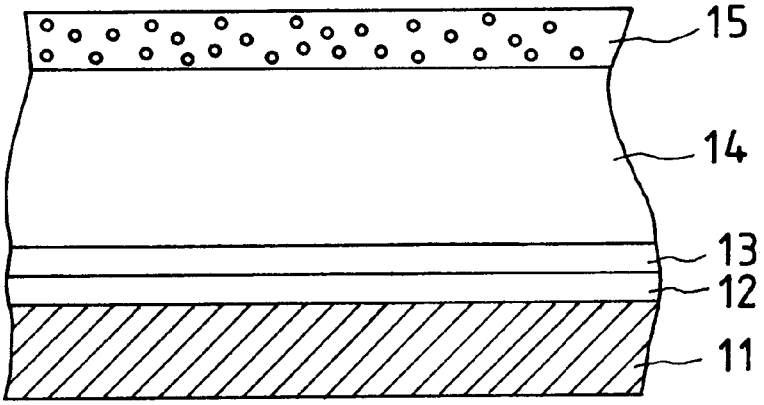
FIG. 1 is a schematic cross sectional view showing an electrophotographic photoreceptor of the present invention.

FIG. 1 is a schematic cross sectional view showing an electrophotographic photoreceptor embodying the present invention. Referring to FIG. 1, the reference numeral 11 represents a electrically conductive substrate; 12, an undercoat layer; 13, a charge generating layer; 14, a charge transporting layer; and 15, a protective layer in which a metal oxide powder is dispersed.

Any substrates can be used as the electrically conductive substrate 11 in the electrophotographic photoreceptors of the present invention as long as they are available for electrophotographic photoreceptors.

Examples of such substrates include metals such as aluminum, nickel, chromium and stainless steel; plastic films provided with thin films of aluminum, titanium, nickel, chromium, stainless steel, gold, vanadium, tin oxide, indium oxide, ITO, etc.; and paper and plastic films coated or impregnated with conductivity imparting agents. These electrically conductive supports are used in appropriate form, for example, in drum-like form or in sheet-like form, but are not limited thereto. Further, surfaces of the electrically conductive supports can be subjected to various treatments as long as images are not adversely affected, as needed. Examples of such treatments include oxidation and treatment with chemical agents of the surfaces, coloring, and treatment for irregular reflection such as sand dressing.

The electrically conductive substrate 11 has a thickness of generally from 0.2 to 5 mm, preferably from 0.7 to 3 mm.

An undercoat layer may be formed on the conductive substrate 11 as needed.

Materials for the undercoat layer 12 include organic metal compounds containing zirconium, titanium, aluminum, manganese, silicon, etc., in addition to high molecular compounds such as acetal resins (e.g., polyvinyl butyral), polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins and melamine resins. Each of these organic metal compounds and these high molecular compounds can be used alone, or as mixtures or polycondensation products thereof. In particular, the organic metal compounds containing zirconium or silicon are preferred because they are excellent in characteristics such as high film forming property, low residual potential, small changes in potential with circumstances, and small changes in potential according to repeated use.

Preferred examples of the silicon compound for the undercoat layer 12 include silane coupling agents such as vinyltriethoxysilane, vinyltrimethoxysilane, vinyltris(2-methoxyethoxysilane), vinylmethyldimethoxysilane, 3-methacryloxypropyltrimethoxysilane, 3-glycidoxypropyltrimethoxysilane, 2-(3,4-epoxycyclohexyl)ethyltrimethoxysilane, N-(2-aminoethyl)-3-aminopropyltrimethoxysilane, N-(2-aminoethyl)-3-aminopropylmethyldimethoxysilane, 3-aminopropyltriethoxysilane, N-phenyl-3-aminopropyltrimethoxysilane, 3-mercaptopropyltrimethoxysilane, 3-chloropropyltrimethoxysilane γ-methacryloxypropyltrimethoxysilane, γ-methacryloxypropylmethyldimethoxysilane, γ-acryloxypropyltrimethoxysilane, γ-methacryloxypropylmethyldiethoxysilane and γ-acryloxypropyltriethoxysilane. They further include vinyltrimethoxysilane, vinyltriacetoxysilane and N,N-bis(β-hydroxyethyl)-γ-aminopropyltriethoxysilane.

Examples of the organic zirconium compound for the undercoat layer 12 include zirconium butoxide, zirconium ethyl acetoacetate, zirconium triethanolamine, acetyl acetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide and isostearate zirconium butoxide.

Examples of the organic titanium compound for the undercoat layer 12 include tetraisopropyl titanate, tetra-n-butyl titanate, butyl titanate dimer, tetra(2-ethylhexyl) titanate, titanium acetylacetonate, polytitanium acetylacetonate, titanium octyleneglycolate, titanium lactate ammonium salt, titanium lactate, titanium lactate ethyl ester, titanium triethanolaminate and polyhydroxy titanium stearate.

Examples of the aluminum compound for the undercoat layer 12 include aluminum isopropylate, monobutoxy aluminum diisopropylate, aluminum butylate, diethyl acetoacetate aluminum diisopropylate and aluminum tris(ethyl acetoacetate).

Each of the above-described zirconium-, titanium-, aluminum- and silicon-containing organic metal compounds is condensable by hydrolysis. When the undercoat layer 12 contains these compounds, very excellent electrophotographic characteristics are obtained by moistening a coated film with wetted hot air.

Various finely divided organic or inorganic powders can be incorporated in the undercoat layer 12, depending on the purpose such as preventing interference fringes or improving electric characteristics. In particular, inorganic pigments used as white pigments such as titanium oxide, zinc oxide, zinc white, zinc sulfide, white lead and lithopone, and used as extender pigments such as alumina, calcium carbonate and barium sulfate, Teflon resin particles, benzoguanamine resin particles, styrene resin particles and finely divided monocrystalline silicon powders are preferred.

The finely divided powders having a particle size within the range from 0.01 μm to 2 μm can be used. Use of the powder having a particle size larger than the above-described range increases unevenness of the undercoat layer 12 and partial electric non uniformity. Defects in image quality are therefore liable to be produced. On the other hand, use of the powders having particle sizes smaller than the above-described range results in insufficient light scattering effect.

Although the above-mentioned finely divided powders are added as needed, they are preferably added in an amount of from 10 to 80% by weight, more preferably from 30 to 70% by weight, based on the solids content of the undercoat layer 12.

In the preparation of a coating solution for the undercoat layer 12, the finely divided powder is added to a solution in which the resin component is dissolved, and dispersed therein. The finely divided powders added can be dispersed in the resin by use of means such as roll mills, ball mills, vibrating ball mills, attriters, sand mills, colloid mills and paint shakers.

Increased thickness of the undercoat layer 12 absorbs unevenness of the conductive substrate 11, and therefore generally tends to reduce the defects in image quality. However, electric repetition stability are also deteriorated. Therefore, the undercoat layer 12 preferably has a thickness of from 0.1 μm to 5 μm.

The photoconductive layer formed on the above-described undercoat layer 12 may basically have a monolayer structure or a laminated structure in which the functions are separated into the charge generating layer 13 and the charge transporting layer 14. For the laminated structure, either of the charge generating layer 13 and the charge transporting layer 14 may be laminated as an upper layer.

The charge generating layer 13 of the present invention is generally formed by vacuum deposition of a charge generating material, or by dispersing the charge generating material with an organic solvent and a binder resin and applying the resulting dispersion.

Examples of the charge generating material used in the present invention include inorganic photoconductive materials such as amorphous selenium, crystalline selenium, selenium-tellurium alloys, selenium-arsenic alloys, other selenium compounds and selenium alloys, zinc oxide and titanium oxide; various phthalocyanine pigments such as nonmetallophthalocyanine, titanyl phthalocyanine, copper phthalocyanine, tin phthalocyanine and gallium phthalocyanine; and various organic pigments and dyes such as Squarilium dye, anthanthrone, perylene, azo, anthraquinone, pyrene, pyrylium salt and thiapyrylium salt pigments and dyes. For the organic pigments, several kinds of crystal forms are generally known. However, any crystal forms can be used as long as they give sensitivity corresponding to the purpose.

Silane coupling agents and/or organic metal alkoxides may be added to the charge generating layer 13 for preventing the charge generating material from aggregating, improving dispersibility of the charge generating material and electric characteristics thereof, etc. Useful examples of the organic metal alkoxide include organic zirconium compounds. When a silane coupling agent and an organic zirconium compound are used in combination, the mixing ratio of the organic zirconium compound to the silane coupling agent is preferably 1:1 to 5:1 in terms of the molar ratio of Zr/Si. If Zr exceeds the above range, wettability of a coating solution for forming a charge generating layer is impaired, resulting in an uneven film. On the other hand, if Si exceeds the above range, the residual potential is increased. The silane coupling agents and/or the organic metal alkoxides may be subjected to surface treatment, for example, by premixing the silane coupling agents and/or the organic metal coupling agents with the charge generating material, and then, dispersed the surface-treated charge generating material to binder resin to prepare a dispersion solution. It is also possible to add them to coating solutions and then apply the resulting solutions, followed by drying. In order to accelerate a hydrolysis hardening reaction, the silane coupling agents or the organic metal alkoxides are also preferably subjected to moistening treatment with wetted hot air, after forming the charge generating layer 13.

Examples of the binder resin for use in the charge generating layer 13 include polycarbonate resins such as bisphenol A type polycarbonates and bisphenol Z type polycarbonates, polyester resins, methacrylic resins, acrylic resins, polyvinyl chloride resins, polystyrene resins, polyvinyl acetate resins, styrene/butadiene copolymer resins, vinylidene chloride/acrylonitrile copolymer resins, vinyl chloride/vinyl acetate copolymer resins, vinyl chloride/vinyl acetate/maleic anhydride terpolymer resins, silicone resins, silicone/alkyd resins, phenol/formaldehyde resins, styrene/alkyd resins and poly(N-vinylcarbazole).

These binder resins may be used either alone or as a mixture of two or more thereof. The compounding ratio of the charge generating material to the binder resin is preferably 10:1 to 1:10 by weight. The thickness of the charge generating layer 13 is generally from 0.01 $\mu$m to 5 $\mu$m, and preferably from 0.05 $\mu$m to 2.0 $\mu$m.

The charge generating material can be dispersed in the resin by use of means such as roll mills, ball mills, vibrating ball mills, attriters, sand mills and colloid mills.

Examples of the charge transporting material for use in the charge transporting layer 14 include oxadiazole derivatives such as 2,5-bis(p-diethylaminophenyl)-1,3,4-oxadiazole, pyrazoline derivatives such as 1,3,5-triphenylpyrazoline and 1-[pyridyl-(2)]-3-(p-diethylaminostyryl)-5-(p-diethylamino-styryl)pyrazoline, aromatic tertiary amino compounds such as triphenylamine, tri(p-methyl)phenylamine, N,N-bis(3,4-dimethylphenyl) biphenyl-4-amine and dibenzylaniline, aromatic tertiary diamino compounds such as N,N'-diphenyl-N,N'-bis(3-methylphenyl)-[1,1-biphenyl]-4,4'-diamine, 1,2,4-triazine derivatives such as 3-(4'-dimethylaminophenyl)-5,6-di-(4'-methoxyphenyl)1,2,4-triazine, hydrazone derivatives such as 4-diethylaminobenzaldehyde-1,1-diphenylhydrazone, quinazoline derivatives such as 2-phenyl-4-styrylquinazoline, benzofuran derivatives such as 6-hydroxy-2,3-di(p-methoxyphenyl)-benzofuran, $\alpha$-stilbene derivatives such as p-(2,2-diphenyl-vinyl)-N,N-diphenylaniline, enamine derivatives, carbazole derivatives such as N-ethylcarbazole, positive hole transporting materials such as poly-N-vinylcarbazole and derivatives thereof, quinone compounds such as chloranil, bromanil and anthraquinone, tetracyanoquinodimethane compounds, fluorenone compounds such as 2,4,7-trinitro-fluorenone and 2,4,5,7-tetranitro-9-fluorenone, xanthone compounds, electron transporting compounds such as thiophene compounds, and polymers having groups composed of the above-mentioned compounds at their main chains or side chains. These charge transporting material may be used either alone or in combination of two or more thereof.

Examples of the binder resin for use in the charge transporting layer 14 include acrylic resins, polyarylates, polyesters, polycarbonate resins such as bisphenol A type polycarbonates and bisphenol Z type polycarbonates, polystyrene, acrylonitrile/styrene copolymers, acrylonitrile/butadiene copolymers, polyvinyl butyral, polyvinyl formal, polysulfones, polyacrylamide, polyamides, insulating resins such as chlorinated rubber, and organic photoconductive polymers such as polyvinylcarbazole, polyvinylanthracene and polyvinylpyrene.

The charge transporting layer 14 can be formed by applying a solution in which the charge transporting material and the binder resin described above are dissolved in an appropriate solvent, and drying it. The solvent for use in forming the charge transporting layer 14 include, for example, aromatic hydrocarbons such as benzene, toluene and chlorobenzene, ketones such as acetone and 2-butanone, halogenated aliphatic hydrocarbons such as methylene chloride, chloroform and ethylene chloride, cyclic or linear ethers such as tetrahydrofuran, dioxane, ethylene glycol and diethyl ether, and mixed solvents thereof. The compounding ratio of the charge transporting material to the above-described binder resin is preferably 10:1 to 1:5. Further, the thickness of the charge transporting layer 14 is generally from 5 $\mu$m to 50 $\mu$m, and preferably from 10 $\mu$m to 40 $\mu$m.

When the photoconductive layer have the monolayer structure, the above-described charge generating material and charge transporting material are added to a binder resin. Examples of the binder resin for use in the photoconductive layer having a monolayer structure include butyral resins, polycarbonate resins, phenoxy resins, silicone-containing hard-coating agents and diphenoquinone derivatives. The photoconductive layer having a monolayer structure generally has a thickness of from 5 to 60 $\mu$m, preferably from 10 to 30 $\mu$m.

In the electrophotographic photoreceptors of the present invention, additives such as antioxidants, light stabilizers and heat stabilizers can be added to the photoconductive layer, for preventing deterioration of the photoreceptors due to ozone or acidic gases generated in the electrophotographic apparatuses, light or heat.

For example, the antioxidants include hindered phenols, hindered amines, p-phenylenediamine, arylalkanes, hydroquinone, spirochroman, spiroindanone, derivatives thereof, organic sulfur compounds and organic phosphorus compounds.

Examples of the light stabilizers include benzophenone, benzotriazole, thiocarbamates, tetramethylpiperidine and derivatives thereof.

The addition amount of the antioxidants or the light stabilizers is generally from 0.01 to 20% by weight, preferably from 0.03 to 10% by weight, based on the solids content of the resin in the photoconductive layer.

At least one kind of electron-accepting substance may be added to the photoconductive layer in order to improve sensitivity, decrease a residual potential, and reduce fatigue in repeated use. The electron-accepting substance available in the photoreceptor of the present invention include, for example, succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid and phthalic acid. Of these, fluorenone derivatives, quinone derivatives and benzene derivatives having electron attractive substituents such as Cl, CN and $NO_2$ are particularly preferred. The addition amount of the electron-accepting substance is generally from 10 to 150 parts by weight, preferably from 10 to 100 parts by weight per 100 parts by weight of the binder resin in the photoconductive layer.

Coating can be performed by methods such as an immersion coating, a spray coating, a bead coating, a blade coating and a roller coating. As to drying, when moistening treatment is not used, drying by heating after set to touch at room temperature is preferably used. The drying by heating is preferably conducted at a temperature of from 30° C. to 200° C. for 5 minutes to 2 hours.

The protective layer 15 is formed on the photoconductive layer. The protective layer 15 for use in the present invention comprises a finely divided metal oxide powder and a binder resin. The binder resin comprises a polymer containing, as a monomer component, an acrylate or a methacrylate having at least one silicon-containing functional group. Furthermore, the polymer constituting the binder resin is crosslinked with the silicon-containing functional group.

Examples of the acrylate or the methacrylate having at least one silicon-containing functional group include compounds represented by the following general formula (I).

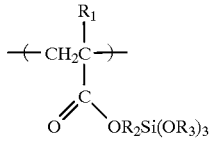

(I)

wherein $R_1$ represents H or $CH_3$, $R_2$ represents $C_nH_{2n}$ (n=1–4), and $R_3$ represents $CH_3$ or $C_2H_5$.

Examples of the compounds represented by the above-mentioned general formula (I) include γ-methacryloxypropyltrimethoxysilane, γ-methacryloxypropyltriethoxysilane, γ-methacryloxypropylmethldimethoxysilane, γ-acryloxypropyltrimethoxysilane and γ-methacryloxypropylmethyldiethoxysilane. Of these, γ-methacryloxypropyltrimethoxysilane and γ-methacryloxypropyltriethoxysilane are preferred.

In the present invention, the protective layer 15 can be formed using a homopolymer composed of the above-described monomer component alone. However, a copolymer containing the above-described monomer component as a constituent of the copolymer is preferably used. When the homopolymer is used as the polymer constituting the binder resin of the protective layer 15, it becomes difficult to hold the finely divided metal oxide powder in the binder resin. Therefore, an organic zirconium compound such as zirconium butoxide is preferably incorporated to overcome this difficulty. Thereby, a protective layer having a thickness of about 1 μm can be formed. The mixing ratio of the organic zirconium compound to the homopolymer is generally from 20 to 95% by weight, preferably 60 to 90% by weight, based on the total weight of the organic compound and the homopolymer. The protective layer 15 formed using the homopolymer is not necessarily sufficient in adhesion to the charge transporting layer 14. Therefore, the above described copolymer is preferably used. When the copolymer is used, the adhesion to the charge transporting layer 14 is improved, and in addition, the wear resistance also becomes sufficient. In the case of using the copolymer, the copolymer preferably contains the monomer component represented by the above-described general formula (I) in an amount of from 5 to 90% by weight, particularly preferably from 5 to 30% by weight, based on the weight of the copolymer. If the amount is less than 5% by weight, the wear resistance becomes poor. On the other hand, if the amount is more than 90% by weight, the adhesion to the charge transporting layer 14 becomes poor with and it may cause separation of them.

Examples of a monomer component copolymerizable with the compounds represented by the above-described general formula (I) include vinyl chloride, vinyl acetate and styrene, and preferred examples thereof include acrylates and methacrylates. The acrylates and the methacrylates include, for example, methyl acrylate, ethyl acrylate, propyl acrylate, isopropyl acrylate, n-butyl acrylate, i-butyl acrylate, t-butyl acrylate, n-hexyl acrylate, 2-ethylhexyl acrylate, octyl acrylate, lauryl acrylate, methyl methacrylate, ethyl methacrylate, propyl methacrylate, isopropyl methacrylate, n-butyl methacrylate, i-butyl methacrylate, t-butyl methacrylate, n-hexyl methacrylate, 2-ethylhexyl methacrylate, octyl methacrylate, lauryl methacrylate and stearyl methacrylate. Of these, methyl methacrylate is preferred because it gives a homopolymer having a high glass transition temperature (Tg) of 105° C., and therefore, the copolymer forms a protective layer having no problem with respect to hardness. However, a terpolymer obtained by further copolymerizing the copolymer with a monomer component giving a lower glass transition temperature (Tg) such as ethyl acrylate, butylacrylate, butyl methacrylate, isopropyl acrylate, 2-ethylhexyl acrylate is preferably used, for imparting higher toughness and for maintaining adhesion to the lower layer for a long period of time. These copolymers and terpolymers preferably have a weight average molecular weight of 10,000 to 100,000.

Examples of the terpolymer preferably used include methyl methacrylate/butyl acrylate/γ-methacryloxypropyltrimethoxysilane terpolymers. The terpolymerization molar ratio thereof is preferably within the range of from 47:44:9 to 10:9:81, and by way of example, the copolymer having a polymerization ratio of 38:35:27 by mol can be used.

The finely divided metal oxide powder include tin oxide, antimony oxide, zinc oxide, titanium oxide, bismuth oxide, indium oxide, mixtures thereof and complex oxides thereof. These finely divided metal oxide powders have an electrical conductivity ranging generally from 1 to $1\times10^9$ Ω·cm, preferably from $10^6$ to $1.5\times10^8$ Ω·cm and a primary particle size ranging generally from 0.01 to 1.0 μm, preferably from 0.01 to 0.3 μm. The compounding amount of the finely divided metal oxide powder is preferably within the range of 10 to 200 parts by weight per 100 parts by weight of the binder resin. If the compounding amount of the finely divided metal oxide powder is less than 10 parts by weight per 100 parts by weight of the binder resin, the residual potential is increased and the density of images is decreased under the conditions of low temperature and low humidity. On the other hand, above 100 parts by weight, deletions and image blurs are generated under the circumstances of high temperature and high humidity. In general, the most suitable range of the compounding amount would be from 120 to 180 parts by weight.

The protective layer 15 can be formed by dispersing the finely divided metal oxide powder in the homopolymer, copolymer or terpolymer containing the above-described acrylate or methacrylate having at least one silicon-containing as a monomer component, applying the resulting dispersion, and then subjecting the polymer to reaction by either moistening or heating or both to harden the polymer by crosslinking reaction with the silicon-containing functional group. In this case, a catalyst such as an organic tin compound can be added to accelerate the crosslinking reaction.

Specifically, the protective layer 15 can be formed in the following manner. First, the finely divided metal oxide powder is dispersed in the above-described binder resin by means of a ball mill or the like, and the organic tin compound is added as the hardening catalyst to the resulting dispersion. The coating solution thus obtained is applied to a surface of the photoconductive layer, for example, by spray coating, followed by drying with heating to form a crosslinked structure of (—Si—O—Si—O—), to thereby form the protective layer 15 in which the metal oxide powder is dispersed in the binder resin.

The thickness of the protective layer 15 is preferably within the range of 0.1 to 10 μm. If the thickness is thinner than 0.1 μm, scratch- and wear-resisting functions become poor, and the film surface is roughened. On the other hand, if the thickness is thicker than 10 μm, the coated film generates saggings, preventing uniform coating.

The above-described protective layer 15 for use in the present invention is excellent in wear resistance, and the electrophotographic photoreceptor of the present invention provided with the protective layer 15 is prevented from generating an image blur under the circumstances of high humidity, and not increased in residual potential under the circumstances of low humidity.

Figure 2:
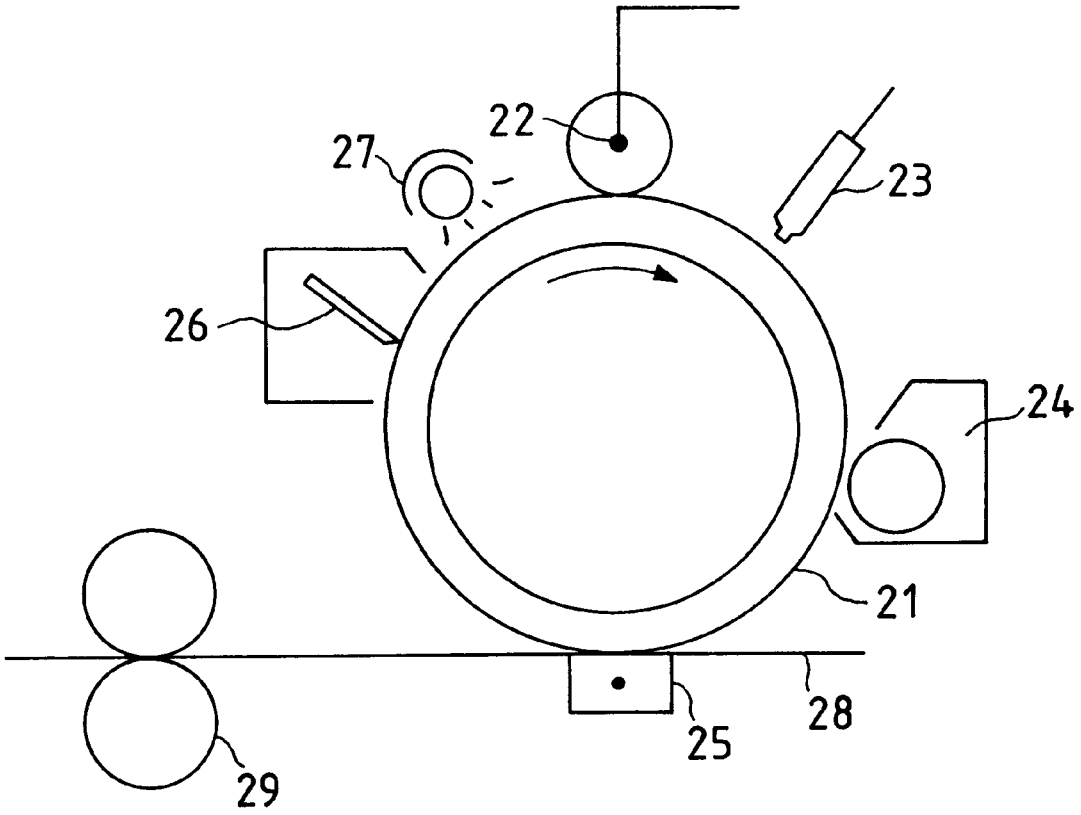
FIG. 2 is a schematic representation showing an electrophotographic apparatus for use in an image forming method of the present invention.

The image forming method according to the present invention will be described referring to FIG. 2. FIG. 2 is a schematic representation showing an electrophotographic apparatus for use in the image forming method of the present invention. Referring to FIG. 2, around an electrophotographic photoreceptor 21 having the above-described protective layer 15, there are disposed a contact charging device 22, an exposing unit 23, a developing device 24, a transferring device 25, a cleaning device 26 and a charge remover 27. The charge remover 27 may be omitted. The electrophotographic photoreceptor 21 is driven for rotation in the direction indicated by the arrow to charge it uniformly with the contact charging device 22. Then, the electrophotographic photoreceptor 21 thus charged is image exposed by use of the exposing unit 23, and a latent image formed is developed with a toner in the developing device. Then, the toner image is transferred to a transfer paper 28 with the transferring device 25 such as corona charger, and fixed with a fixing device 29. The toner remaining on a surface of the electrophotographic photoreceptor 21 is removed by means of the cleaning device 26 provided with a blade cleaner, and the charge is removed with the charge remover 27. The electrophotographic photoreceptor 21 from which the charge has been removed is uniformly charged with the contact charging device 22 again in the subsequent cycle, and images are formed as described above.

In the present invention, charging with the contact charging device may be conducted by use of a cylindrical charging member brought into contact with the photoreceptor, namely a charging roll. This embodiment is preferred because it provides particularly high effect of inhibiting an increase in residual potential. Furthermore, a roller having a surface layer made of an elastic rubber material with a finely divided conductive powder dispersed therein is preferably used as the charging roller.

The present invention will be described in more detail with reference to the following Examples and Comparative Examples, but the invention should not be construed as being limited to these examples. All parts and percents are by weight, unless otherwise specified.

EXAMPLE 1

To 152 parts of n-butyl alcohol was added 8 parts of a polyvinyl butyral resin (SLEK BM-S, manufactured by Sekisui Chemical Co., Ltd.) and mixed with agitation, to obtain a 5% solution of polyvinyl butyral. To the resulting solution was added a mixed solution composed of 100 parts of a 50% toluene solution of tributoxyzirconium acetylacetonate (ZC540, manufactured by Matsumoto Trading Co., Ltd.), 10 parts of γ-aminopropyltrimethoxysilane and 130 parts of n-butyl alcohol. The resulting mixture was agitated with stirrer to obtain a coating solution for forming an undercoat layer.

This coating solution was applied to an aluminum substrate of a 30 mm diameter ED pipe having a surface roughened by honing treatment, and dried with air at room temperature for 5 minute. Then, the substrate was heated at 50° C. for 10 minutes, and placed in a thermo-hygrostat of 50° C. and 85% RH (dew point: 47° C.). After hardening accelerating treatment by moistening for 20 minutes, the substrate was placed in a hot air dryer, and dried at 170° C. for 10 minutes.

A mixture of 15 parts of gallium chloride phthalocyanine, 10 parts of a vinyl chloride-vinyl acetate copolymer (VMCH, manufactured by Nippon Unicar Co., Ltd.) and 300 parts of n-butyl alcohol was dispersed as a charge generating material using a sand mill for 4 hours to prepare a dispersion. The resulting dispersion was applied on the above-described undercoat layer by immersion coating, and dried to form a 0.2 μm thick charge generating layer. Then, 80 parts of chlorobenzene was added to 4 parts of N,N'-diphenyl-N,N'-bis(3-methylphenyl)-[1,1'-biphenyl]-4,4'-diamine and 6 parts of a bisphenol Z type polycarbonate resin (molecular weight: 40,000) to dissolve them. The resulting solution was applied on the above-described charge generating layer and dried to form a charge transporting layer having a thickness of 20 μm. Thus, an electrophotographic photoreceptor composed of three layers was produced.

Then, 32 parts of a finely divided tin oxide powder (S-1, manufactured by Mitsubishi Material Co., Ltd.) in which particles are distributed so that about 90% thereof have primary particle sizes of 1.3 μm or less, about 30% thereof have primary particle sizes of 0.15 μm or less, and about 30% thereof have primary particle sizes of 0.15 to 0.25 μm was added to 43 parts of a resin base (solid content: 48%) containing an acrylic copolymer having a silicon-containing functional group and composed of three monomer components, methyl methacrylate, butyl acrylate and γ-methacryloxypropyltrimethoxysilane. The polymerization ratio of the three monomer components is 38:35:27 by mol, and the acrylic copolymer has a number average molecular weight (Mn) of 11,000 and a weight average molecular weight (Mw) of 34,000. To the mixture, 30 parts of xylene was added as a diluent. The resulting mixture and 500 parts of spherical media made of stainless steel having diameters of 15 mm and 13 mm were placed in a ball mill pot made of stainless steel having a diameter of about 90 mm and a height of 90 mm, and subjected to dispersing treatment at 120 rpm for 20 hours to mix them. Then, the dispersion was passed through a filter to take out the binder resin with the finely divided tin oxide powder dispersed therein, and 143 parts of the above-described diluent, xylene, was further added to and mixed with the binder resin. In addition, 0.3 part of an organic tin compound (S-cat 24, manufactured by Sankyo Organic Chemicals Co., Ltd.) was added thereto as a catalyst for hardening initiation. The finely divided tin oxide powder was added in an amount of 155 parts per 100 parts of binder resin.

The resulting coating solution was applied by spray coating on the charge transporting layer formed as described above to form a protective layer having a thickness of about 3 μm. The coating solution was sprayed to a surface of the charge transporting layer at a distance of about 50 cm therefrom, using an Iwata automatic spray gun SA-88 (manufactured by Iwata Air Compressor Mfg. Co., Ltd.), at an air pressure of 3 kg/cm$^2$, in an amount of coating solution sprayed of about 110 cc/minute, at a pattern opening of about 130 mm, while rotating the aluminum pipe at 70 rpm. Then, the coated layer thus formed was subjected to crosslinking reaction at 140° C. for 4 hours to harden and dry it, to thereby obtain an intended electrophotographic photoreceptor having the protective layer little in an increase in residual potential and excellent in wear resistance.

Figure 3:
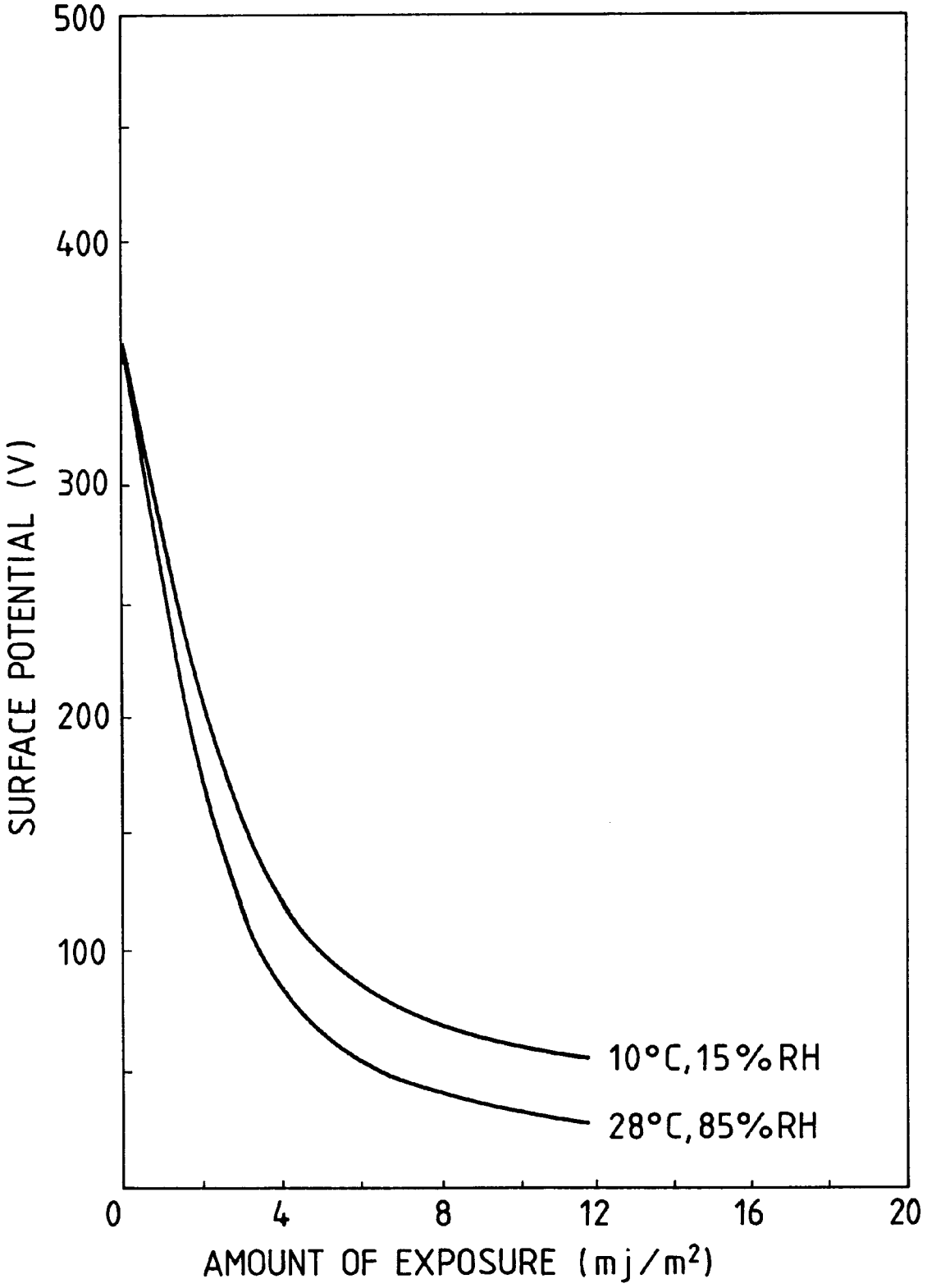
FIG. 3 is a graph showing light decay performance of the electrophotographic photoreceptor of Example 1.

This electrophotographic photoreceptor was mounted on a printer employing the contact charging roller system (PC-PR1000/4R manufactured by NEC Corporation), and about 10,000 copies were continuously taken at low temperature and low humidity. During this, no problem was encountered with respect to image quality. The residual potential of the photoreceptor was measured to be about 80 V, which was a level having no problem at all in its use. The surface of the photoreceptor was observed three times until 10,000 copies were performed, and consequently, the surface was extremely clean. The light decay performance was measured for this photoreceptor. When the photoreceptor charged to about 360 V was exposed to the light having a wavelength of 780 nm at 10 mJ/m$^2$, the potential was decayed to about 60 V at low temperature and humidity (10° C., 15% RH). Successively, about 10,000 copies were obtained at low temperature and low humidity. During this, there was no problem of a decrease in image density, and the surface of the photoreceptor was extremely clean. The light decay performance at the 140th cycle under the circumstances of low temperature and low humidity (10° C., 15% RH) and high temperature and high humidity (28° C., 85% RH) is shown in FIG. 3.

Figure 6A:
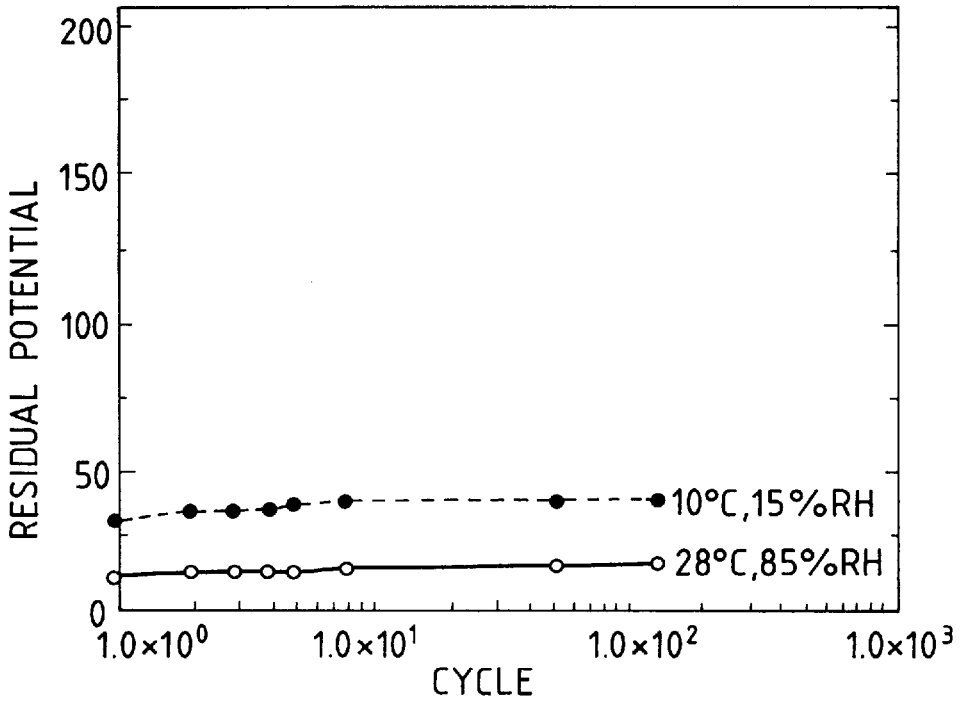
FIGS. 6A and B are graphs showing the cycle characteristic of residual potential on the surface of the electrophotographic photoreceptor of Example 1 and that of Comparative Example 1, respectively.
Figure 6B:
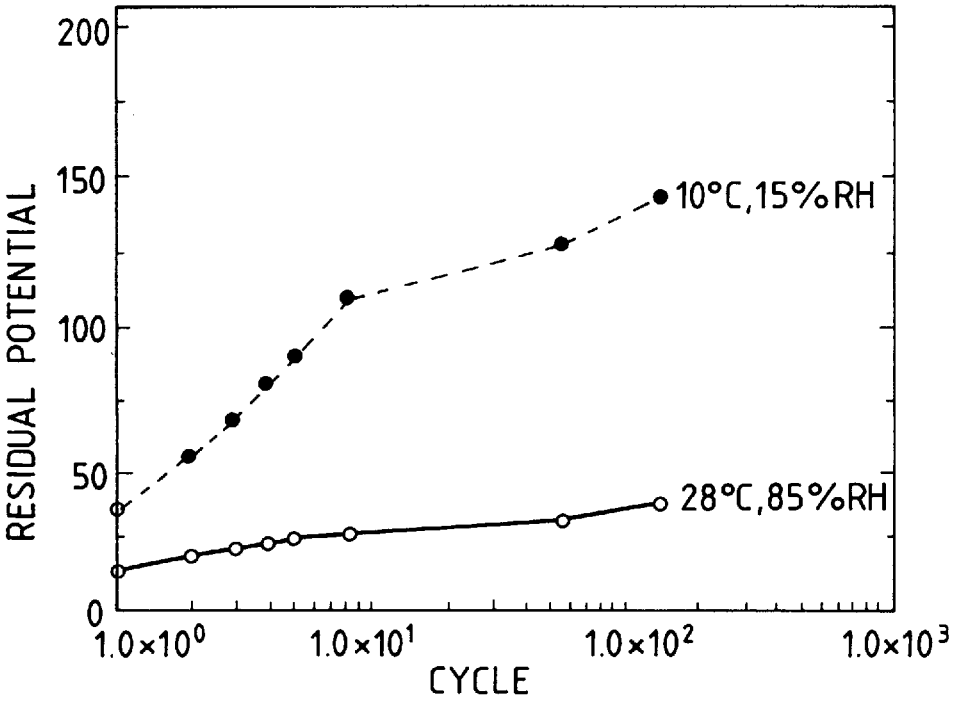

Further, the cycle characteristic of the residual potential on the surface of the photoreceptor under the circumstances of low temperature and low humidity and high temperature and high humidity is shown in FIG. 6(*a*).

Figure 5:
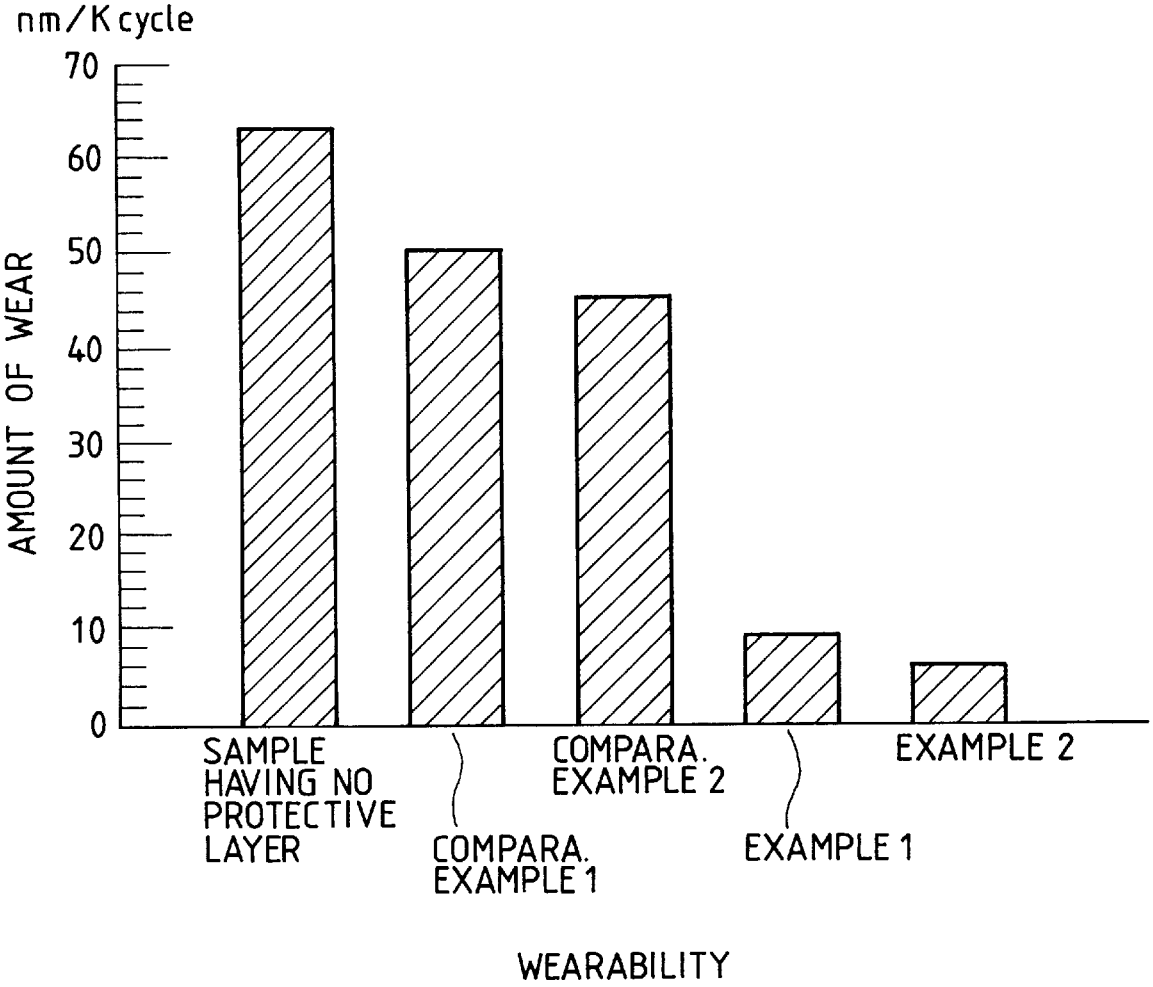
FIG. 5 is a graph comparing the amount of wear for Examples 1 and 2, Comparative Examples 1 and 2, and the case that no protective layer is provided.

Then, the amount of wear was measured. Measurement was made with an eddy current thickness tester (Fischerscope Type E100, manufactured by Helmut Fischer GMBH), and the amount of wear before and after printing was measured. When the number of prints was increased up to 100,000 copies, an amount of wear of 9 nm per 1,000 cycles was observed. This shows about the seven-times wear resistance as much as that of the photoreceptor having no protective layer. The amount of wear is shown in FIG. 5.

COMPARATIVE EXAMPLE 1

An undercoat layer, a charge generating layer and a charge transporting layer were formed in the same manner as in Example 1.

Then, a coating solution for forming a protective layer was prepared in the same manner as in Example 1 except that M-2000 (manufactured by Soken Chemical & Engineering Co., Ltd.) composed of methyl methacrylate was used in place of the binder resin of Example 1 in an amount of 210 parts so as to give the same resin solid content as in Example 1. This coating solution was applied using the spray coating device used in Example 1 to a film thickness of about 4 μm, and hardened and dried at 150° C. for 1 hour to form a wear-resistant protective layer.

The resulting electrophotographic photoreceptor was mounted on a printer (PC-PR1000/4R manufactured by NEC Corporation), and 2,500 copies were continuously taken at low temperature and low humidity. As a result, a slight decrease in image density was observed from the time when about 2,400 copies were taken. At this time, the residual potential of the photoreceptor was measured at the development position, and it reached about 220 V. The decrease in image density is therefore considered to be attributed to the increase in residual potential. Further, printing obtained at high temperature and high humidity using this photoreceptor slightly exhibited lower image resolutions and image deletions by lateral conduction.

Figure 4:
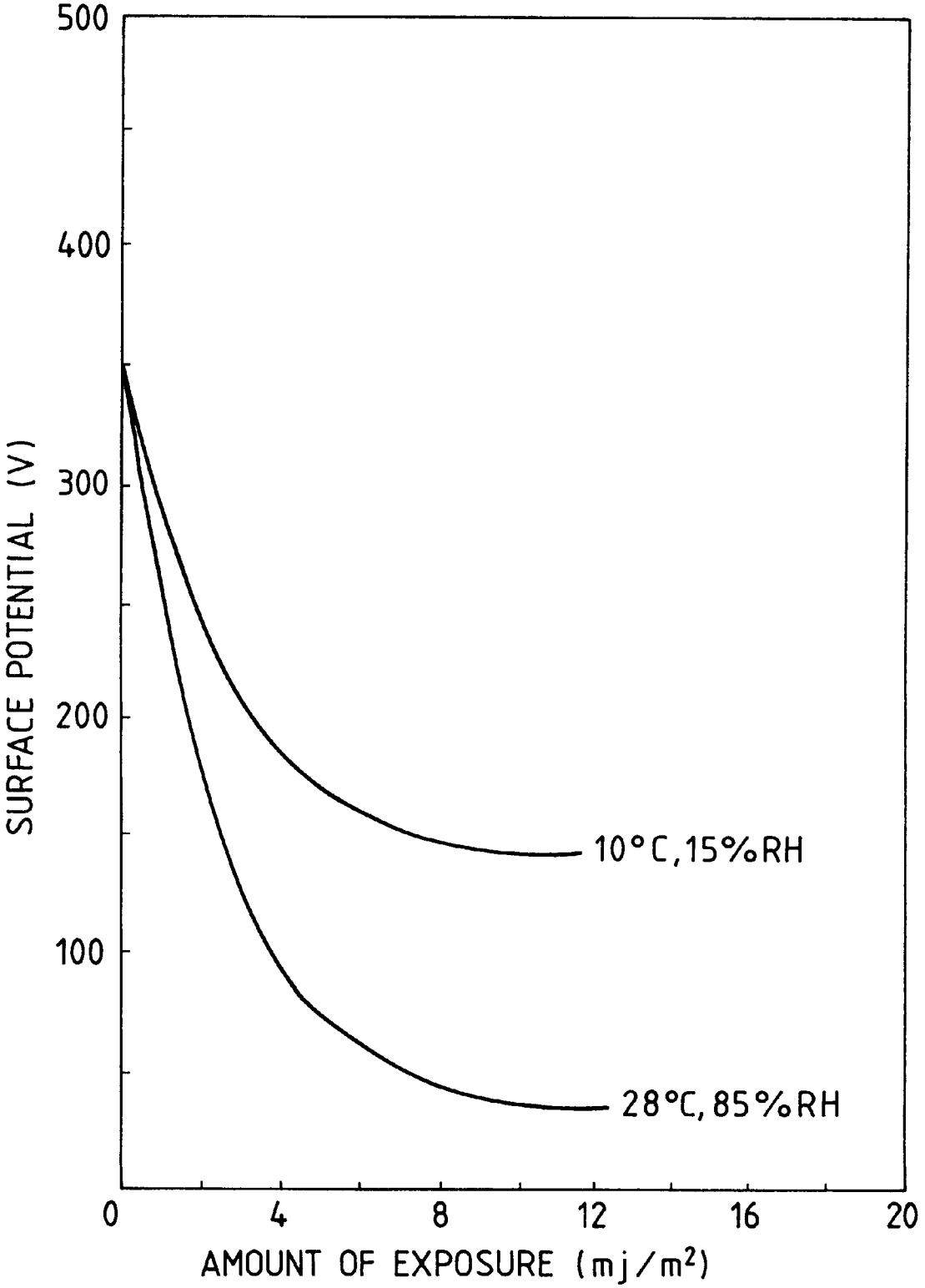
FIG. 4 is a graph showing light decay performance of the electrophotographic photoreceptor of Comparative Example 1.

The light decay performance was measured for this photoreceptor. When the photoreceptor charged to about 360 V was exposed to the light having a wavelength of 780 nm at 10 mJ/m$^2$, the potential was decayed to about 150 V at low temperature and low humidity. The light decay performance at the 140th cycle under the circumstances of low temperature and low humidity (10° C., 15% RH) and high temperature and high humidity (28° C., 85% RH) is shown in FIG. 4.

Further, the cycle characteristic of the residual potential on the surface of the photoreceptor under the circumstances of low temperature and low humidity, and high temperature and high humidity is shown in FIG. 6(*b*).

Then, changes in film thickness were measured in the same manner as in Example 1. As a result, an amount of wear of 50 nm per 1,000 cycles was observed after 100,000 copies. Results thereof are shown in FIG. 5.

EXAMPLE 2

An undercoat layer, a charge generating layer and a charge transporting layer were formed in the same manner as in Example 1.

Then, 26 parts of a finely divided tin oxide powder (S-1, manufactured by Mitsubishi Material Co., Ltd.) in which particles are distributed so that about 90% thereof have primary particle sizes of 1.3 μm or less, about 30% thereof have primary particle sizes of less than 0.15 μm, and about 30% thereof have primary particle sizes of 0.15 to 0.25 μm was added to 43 parts of a resin base (solid content: 49%) containing an acrylic copolymer having a silicon-containing functional group and composed of two monomer components, methyl methacrylate and γ-methacryloxypropyltrimethoxysilane. The copolymerization ratio of the two monomer components is 65:35 by mol, and the acrylic copolymer has a number average molecular weight (Mn) of 8,500 and a weight average molecular weight (Mw) of 18,000. To the mixture, 30 parts of xylene was added as a diluent. The resulting mixture and 500 parts of spherical media made of stainless steel having diameters of 15 mm and 13 mm were placed in a ball mill pot made of stainless steel having a diameter of about 90 mm and a height of 90 mm, and subjected to dispersing treatment at 120 rpm for 20 hours to mix them. Then, the dispersion was passed through a filter to take out the binder resin with the finely divided tin oxide powder dispersed therein, and 143 parts of the above-described diluent, xylene, was further added to and mixed with the binder resin. In addition, 0.05 part of an organic tin compound (S-cat 24, manufactured by Sankyo Organic Chemicals Co., Ltd.) per 100 parts of solids in the resin was added thereto as a catalyst for hardening initiation. The finely divided tin oxide powder was added in an amount of 55 parts per 100 parts of the total amount of the binder resin and the finely divided tin oxide powder.

The resulting coating solution was applied by spray coating on the charge transporting layer in the same manner as in Example 1 to form a protective layer having a thickness of about 3 μm. Then, the coated layer thus formed was subjected to crosslinking reaction at 140° C. for 4 hours to harden and dry it, to thereby obtain an intended electrophotographic photoreceptor having the protective layer little in an increase in residual potential and excellent in wear resistance.

Figure 7:
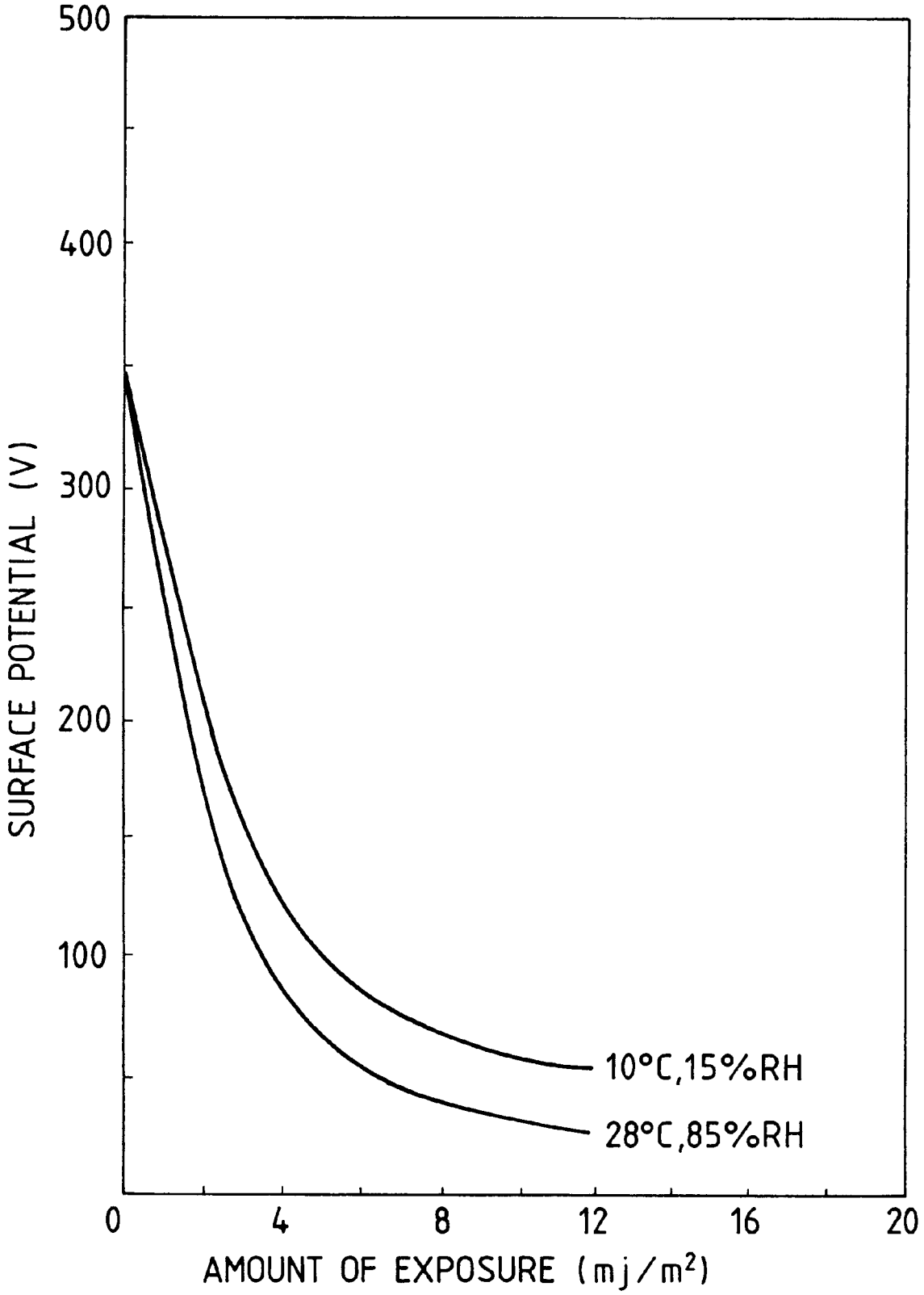
FIG. 7 is a graph showing light decay performance of the electrophotographic photoreceptor of Example 2.

This electrophotographic photoreceptor was mounted on the same printer as used in Example 1, and about 10,000 copies were continuously taken at low temperature and low humidity. During this, no problem was encountered with respect to image quality. The residual potential of the photoreceptor was measured to be about 60 V, which was a level having no problem at all in its use. The surface of the photoreceptor was observed three times until 10,000 copies were performed, and consequently, the surface was extremely clean. The light decay performance was measured for this photoreceptor. As a result, when the photoreceptor charged to about 360 V was exposed to the light having a wavelength of 780 nm at 10 mJ/m$^2$, the potential was decayed to about 60 V at low temperature and low humidity (10° C., 15% RH). Successively, about 10,000 copies were obtained at low temperature and low humidity. During this, there was no problem of a decrease in image density, and the surface of the photoreceptor was extremely clean. The light decay performance at the 140th cycle under the circumstances of low temperature and low humidity (10° C., 15% RH) and high temperature and high humidity (28° C., 85% RH) is shown in FIG. 7.

Figure 9A:
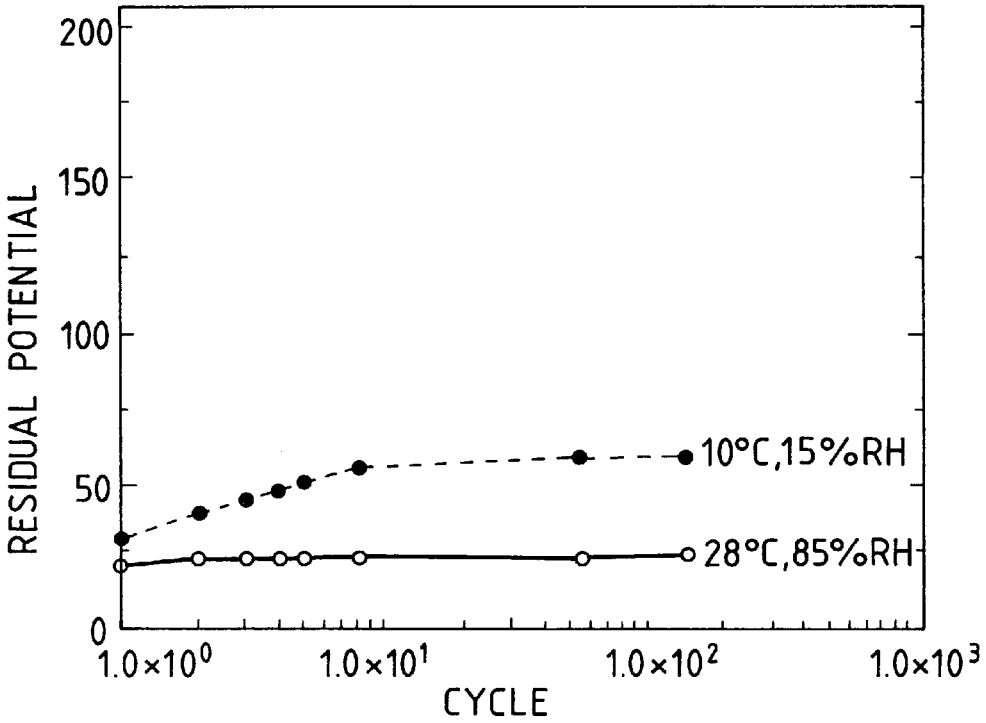
FIGS. 9A and B are graphs showing the cycle characteristic of residual potential on the surface of the electrophotographic photoreceptor of Example 2 and that of Comparative Example 2, respectively.
Figure 9B:
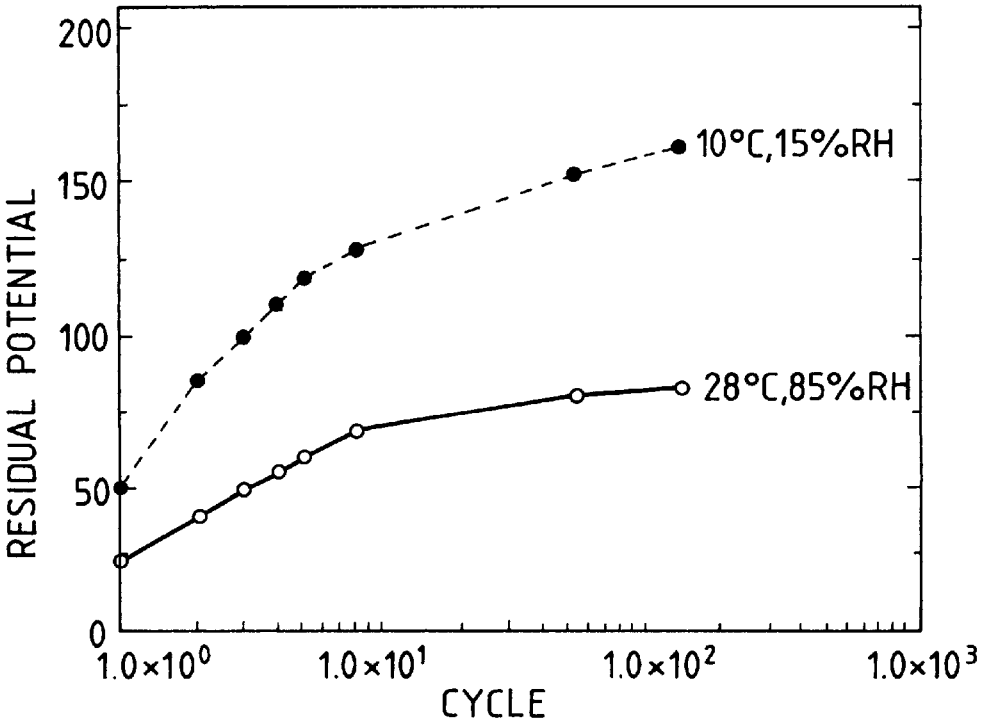

Further, the cycle characteristic of the residual potential on the surface of the photoreceptor under the circumstances of low temperature and low humidity and high temperature and high humidity is shown in FIG. 9(*a*).

Then, the amount of wear was measured in the same manner as in Example 1. When the number of prints was increased up to 100,000 copies, an amount of wear of 6 nm per 1,000 cycles was observed. This shows about the ten-times wear resistance as much as that of the photoreceptor having no protective layer.

COMPARATIVE EXAMPLE 2

An undercoat layer, a charge generating layer and a charge transporting layer were formed in the same manner as in Example 1.

Then, a coating solution for forming a protective layer was prepared in the same manner as in Example 1 except that LSI-60 (manufactured by Soken Chemical & Engineering Co., Ltd.) (solid content: 10%), which is a resin having an ethyl methacrylate polymer as a main chain and polydimethylsiloxane as a side chain, was used in place of the binder resin of Example 1 in an amount of 210 parts so as to give the same resin solid content as in Example 1. This coating solution was applied using the spray coating device used in Example 1 to a film thickness of about 4 μm, and hardened and dried at 150° C. for 1 hour to form a wear-resistant protective layer.

The resulting electrophotographic photoreceptor was mounted on a printer (PC-PR1000/4R manufactured by NEC Corporation), and 2,500 copies were continuously taken at low temperature and low humidity. As a result, a slight decrease in image density was observed from the time when about 2,400 copies were taken. At this time, the residual potential of the photoreceptor was measured at the development position, and it reached about 250 V. The decrease in image density is therefore considered to be attributed to the increase in residual potential. Further, printing at high temperature and high humidity using this photoreceptor slightly exhibited lower image resolutions and image deletions by lateral conduction.

Figure 8:
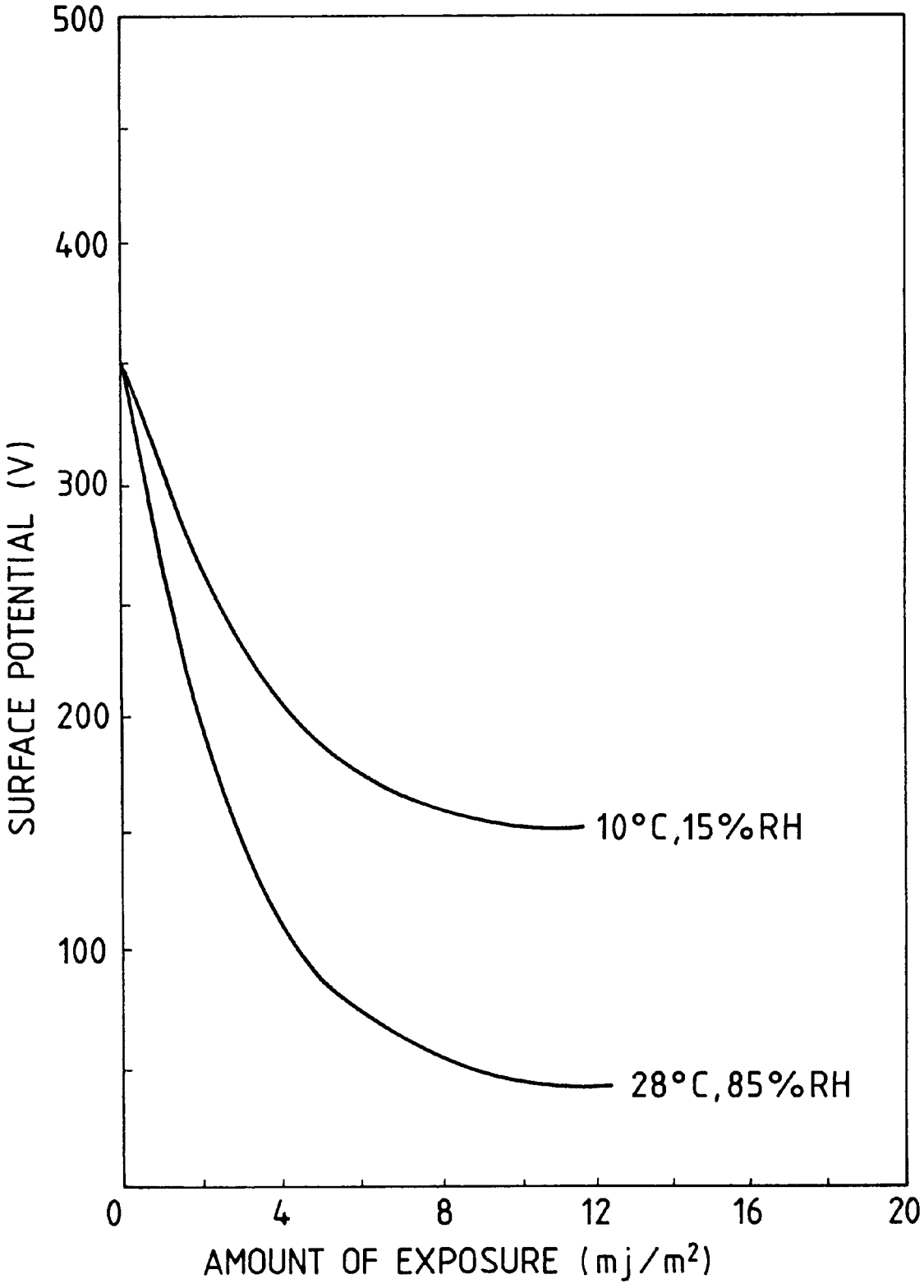
FIG. 8 is a graph showing light decay performance of the electrophotographic photoreceptor of Comparative Example 2.

The light decay performance was measured for this photoreceptor. When the photoreceptor charged to about 360 V was exposed to the light having a wavelength of 780 nm at 10 mJ/m$^2$, the potential was decayed to about 170 V at low temperature and low humidity. The light decay performance at the 140th cycle under the circumstances of low temperature and low humidity (10° C., 15% RH) and high temperature and high humidity (28° C., 85% RH) is shown in FIG. 8.

Further, the cycle characteristic of the residual potential on the surface of the photoreceptor under the circumstances of low temperature and low humidity and high temperature and high humidity is shown in FIG. 9(*b*).

Then, changes in film thickness were measured in the same manner as in Example 1. As a result, an amount of wear of 45 nm per 1,000 cycles was observed after 100,000 copies.

EXAMPLE 3

An undercoat layer, a charge generating layer and a charge transporting layer were formed in the same manner as in Example 1.

Then, 32 parts of a finely divided tin oxide powder (S-1, manufactured by Mitsubishi Material Co., Ltd.) in which particles are distributed so that about 90% thereof have primary particle sizes of 1.3 μm or less, about 30% thereof have primary particle sizes of less than 0.15 μm, and about 30% thereof have primary particle sizes of 0.15 to 0.25 μm was added to 43 parts of a resin base (solid content: 48%) containing an acrylic copolymer having a silicon-containing functional group and composed of three monomer components, methyl methacrylate, butyl acrylate and γ-methacryloxypropyltrimethoxysilane. The copolymerization ratio of the three components is 38:35:27, and the acrylic copolymer has a number average molecular weight (Mn) of 11,000 and a weight average molecular weight (Mw) of 34,000. To the mixture, 30 parts of xylene was added as a diluent. The resulting mixture and 500 parts of spherical media made of stainless steel having diameters of 15 mm and 13 mm were placed in a ball mill pot made of stainless steel having a diameter of about 90 mm and a height of 90 mm, and subjected to dispersing treatment at 120 rpm for 20 hours to mix them. Then, the dispersion was passed through a filter to take out the binder resin with the finely divided tin oxide powder dispersed therein, and 143 parts of the above-described diluent, xylene, was further added to and mixed with the binder resin. However, no catalyst for hardening initiation was added. The finely divided tin oxide powder was added in an amount of 60 parts per 100 parts of the total solid amount of the binder resin and the finely divided tin oxide powder.

The resulting coating solution was applied by spray coating on the charge transporting layer in the same manner as in Example 1 to form a protective layer having a thickness of about 3 $\mu$m. Then, the coated layer thus formed was subjected to crosslinking reaction at 170° C. for 1 hour to harden and dry it, to thereby obtain an intended electrophotographic photoreceptor having the protective layer little in an increase in residual potential and excellent in wear resistance.

This electrophotographic photoreceptor was mounted on the same printer as used in Example 1, and about 10,000 copies were continuously taken at low temperature and low humidity. During this, no problem was encountered with respect to image quality. The residual potential of the photoreceptor was measured to be about 60 V, which was a level having no problem at all in its use. The surface of the photoreceptor was observed three times until 10,000 copies were performed, and consequently, the surface was extremely clean. The light decay performance was measured for this photoreceptor. When the photoreceptor charged to about 360 V was exposed to the light having a wavelength of 780 nm at 10 mJ/m$^2$, the potential was decayed to about 60 V at low temperature and low humidity (10° C., 15% RH). Successively, about 10,000 copies were obtained at low temperature and low humidity. During this, there was no problem of a decrease in image density, and the surface of the photoreceptor was extremely clean.

The light decay performance at the 140th cycle under the circumstances of low temperature and low humidity (10° C., 15% RH) and high temperature and high humidity (28° C., 85% RH) and the cycle characteristic of the residual potential on the surface of the photoreceptor under the circumstances of low temperature and low humidity and high temperature and high humidity showed the same performance as in Example 1.

Then, the amount of wear was measured in the same manner as in Example 1. When the number of prints was increased up to 100,000 copies, an amount of wear of 6 nm per 1,000 cycles was observed. This shows about the ten-times wear resistance as much as that of the photoreceptor having no protective layer.

As described above, the electrophotographic photoreceptor of the present invention comprises the acrylic polymer having at least one silicon-containing functional group as the binder resin of the protective layer, to thereby exhibit very good cycle stability of electric characteristics and excellent wear resistance. Further, according to the image forming method of the present invention using this electrophotographic photoreceptor, images having no lower image resolution and no image deletion by lateral conduction, and excellent in image quality can be obtained for a long period of time.

While the invention has been described in detail and with reference to specific examples, it will be apparent to one skilled in the art that various changes and modifications can be made without departing from the spirit and scope thereof.

What is claimed is:

1. An electrophotographic photoreceptor comprising an electrically conductive support having thereon a photoconductive layer and a protective layer in this order, wherein said protective layer contains (a) a finely divided metal oxide powder and (b) a binder resin comprising a hardened polymer containing an acrylate or a methacrylate monomer having at least one silicon-containing functional group and represented by the following formula:

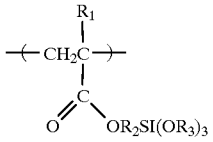

wherein $R_1$ represents H or $CH_3$, $R_2$ represents $C_nH_{2n}$ with n from 1 to 4, and $R_3$ represents $CH_3$ or $C_2H_5$, and wherein said silicon-containing functional group of said hardened polymer is crosslinked, and wherein said polymer comprises a homopolymer of said monomer or a terpolymer of said monomer, an acrylate monomer and a methacrylate monomer.

2. The electrophotographic photoreceptor as claimed in claim 1, wherein said binder resin contains said monomer in an amount of not less than 5% by weight based on the total weight of said binder resin.

3. The electrophotographic photoreceptor as claimed in claim 1, wherein said photoconductive layer comprises a charge generating layer and a charge transporting layer.

4. The electrophotographic photoreceptor as claimed in claim 1, wherein said metal oxide powder is selected from the group consisting of tin oxide, antimony oxide, zinc oxide, titanium oxide, bismuth oxide, indium oxide and mixtures thereof.

5. The electrophotographic photoreceptor as claimed in claim 1, wherein said monomer is selected from the group consisting of γ-methacryloxypropyltrimethoxysilane and γ-methacryloxypropyltriethoxysilane.

6. The electrophotographic photoreceptor as claimed in claim 1, further comprising an organic zirconium compound.

7. The electrophotographic photoreceptor as claimed in claim 6, wherein said zirconium compound is zirconium butoxide.

8. The electrophotographic photoreceptor as claimed in claim 7, wherein a mixing ratio of said organic zirconium to said homopolymer is from 20 to 95% by weight based on a total weight of said zirconium organic compound and said homopolymer.

9. The electrophotographic photoreceptor as claimed in claim 1, wherein said terpolymer is a methyl methacrylate/butyl acrylate/γ-methacryloxypropyltrimethoxysilane terpolymer.

10. The electrophotographic photoreceptor as claimed in claim 1, wherein a molar ratio of said terpolymer is within a range from 47:44:9 to 10:9:81.

11. The electrophotographic photoreceptor as claimed in claim 1, further comprising an organic tin crosslinking catalyst.

12. The electrophotographic photoreceptor as claimed in claim 1, wherein said metal oxide powder has a particle size of from 0.01 to 1.0 $\mu$m.

13. The electrophotographic photoreceptor as claimed in claim 1, wherein said protective layer has a thickness of 0.1 to 10 $\mu$m.

14. An image forming method which comprises:

forming an electrostatic latent image on an electrophotographic photoreceptor comprising an electrically conductive support having thereon a photoconductive layer and a protective layer in this order;

developing said latent image to form a toner image;

transferring said toner image; and cleaning the surface of said electrophotographic photoreceptor with a contact cleaning means to repeatedly form an image, wherein said protective layer of the electrophotographic photoreceptor contains (a) a finely divided metal oxide powder and (b) a binder resin comprising a hardened polymer containing an acrylate or a methacrylate monomer having at least one silicon-containing functional group and represented by the following formula:

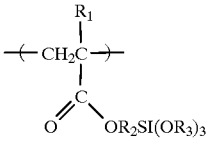

wherein $R_1$ represents H or $CH_3$, $R_2$ represents $C_nH_2$, with n from 1 to 4, and $R_3$ represents $CH_3$ or $C_2H_5$, and wherein said silicon-containing functional group of said hardened polymer is crosslinked, and wherein said polymer comprises a homopolymer of said monomer or a terpolymer of said monomer, an acrylate monomer and a methacrylate monomer.

* * * * *